United States Patent [19]

Ohtsu et al.

[11] Patent Number: 4,773,581

[45] Date of Patent: Sep. 27, 1988

[54] COMBUSTION GAS POWERED TOOL

[75] Inventors: Shinki Ohtsu, Ibaraki; Yo Kawakami, Mito; Hiromu Utsumi, Katsuta, all of Japan

[73] Assignee: Hitachi Koki Company, Ltd., Tokyo, Japan

[21] Appl. No.: 41,379

[22] Filed: Apr. 23, 1987

[30] Foreign Application Priority Data

Jun. 13, 1986 [JP] Japan ..... 61-139080
Sep. 12, 1986 [JP] Japan ..... 61-216178

[51] Int. Cl.[4] ..... B25C 1/08
[52] U.S. Cl. ..... 227/10; 123/46 SC; 227/8
[58] Field of Search ..... 60/632, 637; 123/46 SC; 227/9, 10, 11

[56] References Cited

U.S. PATENT DOCUMENTS

| | | | |
|---|---|---|---|
| 4,403,722 | 9/1983 | Nikolich | 227/8 |
| 4,483,473 | 11/1984 | Wagdy | 227/8 |
| 4,483,474 | 11/1984 | Nikolich | 227/8 |
| 4,522,162 | 6/1985 | Nikolich | 123/46 SC |
| 4,665,868 | 5/1987 | Adams | 123/46 SC |

*Primary Examiner*—Paul A. Bell
*Attorney, Agent, or Firm*—Pollock, VandeSande & Priddy

[57] ABSTRACT

A housing partially defines a combustion chamber. A movable piston partially defines the combustion chamber. An air and fuel mixture is generated in the combustion chamber. The air and fuel mixture is ignited in the combustion chamber. An obstacle member is fixedly disposed in the combustion chamber. The obstacle member serves to generate turbulence in an unburned portion of the air and fuel mixture after the air and fuel mixture is ignited. Fuel may be injected into at least two points in the combustion chamber.

6 Claims, 6 Drawing Sheets

COMBUSTION GAS POWERED TOOL

BACKGROUND OF THE INVENTION

1. Field of the Invention

This invention relates generally to a combustion gas powered tool, and specifically to a combustion gas powered fastener driving tool such as a combustion gas powered tacker or nailer.

2. Description of the Prior Art

U.S. Pat. No. 4,403,722 discloses a combustion gas powered fastener driving tool which includes a movable piston and a gas combustion system for powering the piston. In this tool, the piston is moved by exploding gas. A fastener driver carried on the piston is actuated in accordance with movement of the piston. The gas combustion system has an air and fuel mixture exploding chamber in which blades of a fan are disposed. The fan allows the air and fuel to thoroughly mix, thereby insuring rapid mixture combustion. In general, the rapid mixture combustion enhances the power output characteristic and the efficiency of the gas combustion system.

In the tool of U.S. Pat. No. 4,403,722, the fan is driven by an electric motor partially disposed within the mixture exploding chamber. Since the fan and a portion of the electric motor are disposed within the mixture exploding chamber, they are exposed to high temperatures resulting from the combustion of the air and fuel mixture. These high temperatures tend to adversely affect the fan drive motor. Specifically, the high temperatures tend to deteriorate lubrication of bearings of the motor and tend to cause a breakdown of electrical insulation of the motor. Accordingly, this tool has a problem in durability.

SUMMARY OF THE INVENTION

It is an object of this invention to provide a durable and efficient combustion gas powered tool.

In a combustion gas powered tool according to a first aspect of this invention, a housing partially defines a combustion chamber. A movable piston partially defines the combustion chamber. An air and fuel mixture is generated in the combustion chamber. The air and fuel mixture is ignited in the combustion chamber. An obstacle member is fixedly disposed in the combustion chamber. The obstacle member serves to generate turbulence in an unburned portion of the air and fuel mixture after the air and fuel mixture is ignited. Fuel may be injected into at least two points in the combustion chamber.

In a combustion gas powered tool according to a second aspect of this invention, a housing partially defines a combustion chamber. A movable piston partially defines the combustion chamber. Fuel is injected into at least two points in the combustion chamber.

BRIEF DESCRIPTION OF THE DRAWINGS

Like and corresponding elements are denoted by the same reference characters throughout the drawings.

DESCRIPTION OF THE PREFERRED EMBODIMENTS

Figure 1:
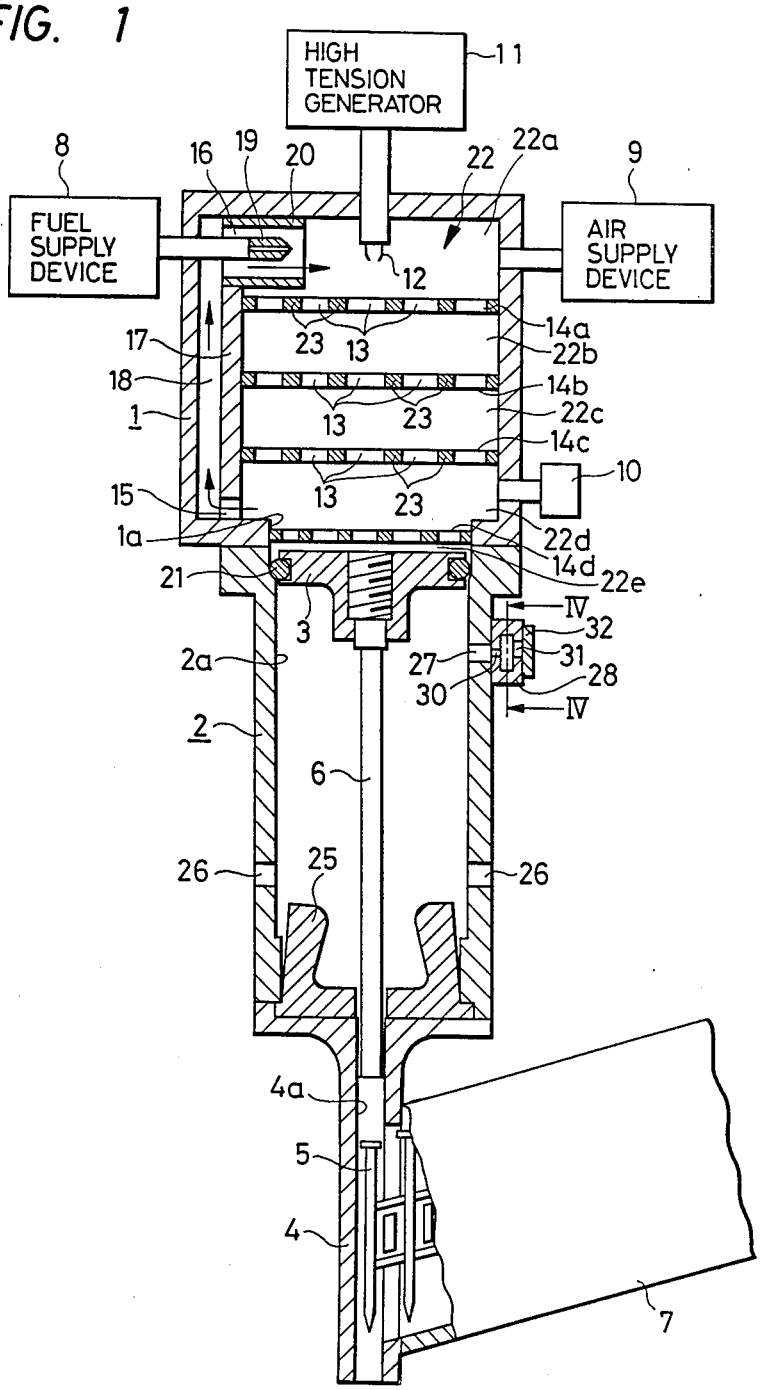
FIGS. 1 and 2 are sectional views of a combustion gas powered fastener driving tool in different states respectively, according to a first embodiment of this invention.
Figure 2:
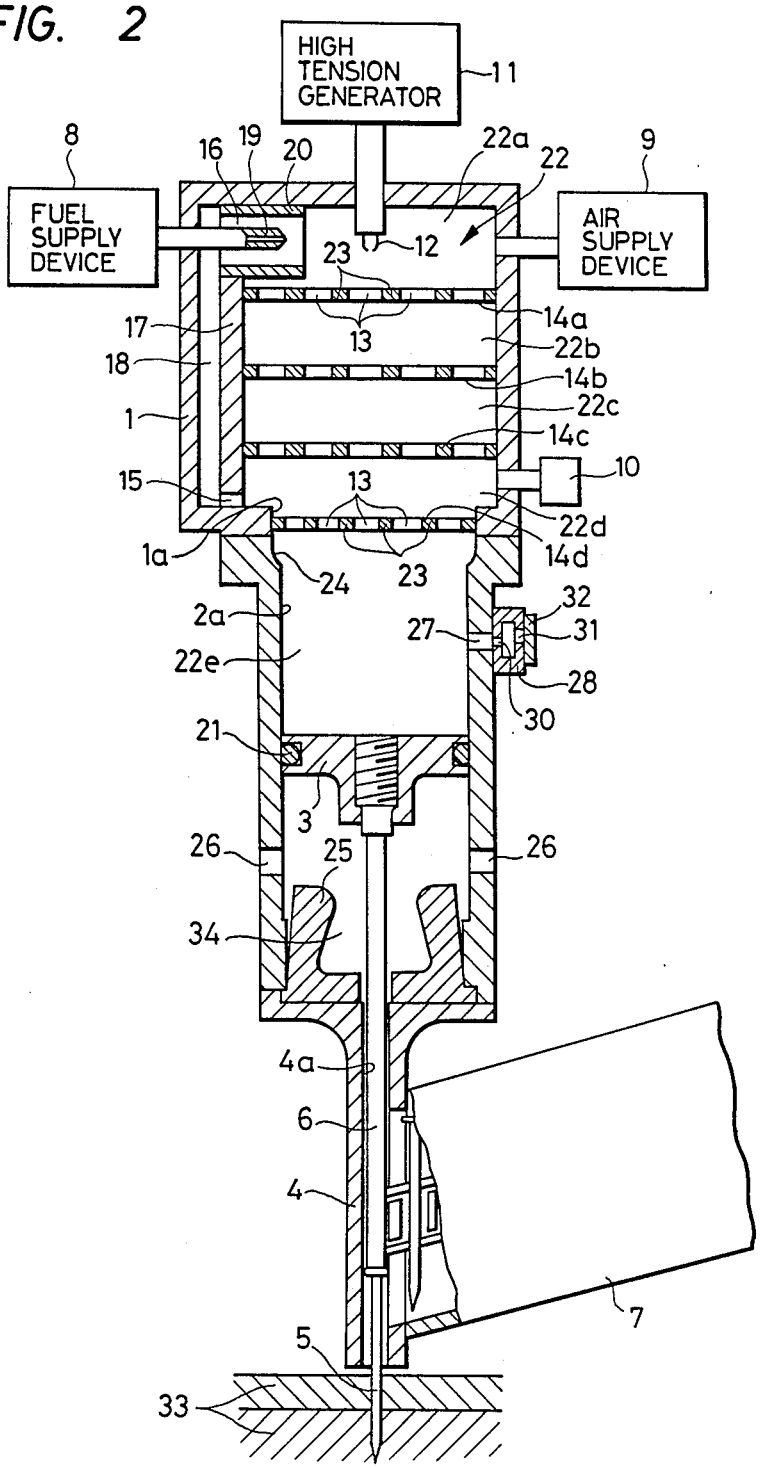

With reference to FIGS. 1 and 2 showing a first embodiment of this invention, a combustion gas powered fastener driving tool or nailer includes a hollow cylindrical housing or cylinder head 1. The axis of the housing 1 extends vertically as viewed in FIGS. 1 and 2. The housing 1 has a closed end and an open end defining an opening 1*a*. A tubular cylinder 2 extends approximately coaxially with the housing 1. An end of the cylinder 2 is connected to the open end of the housing 1. The cylinder 2 has an axial bore 2*a* leading from the opening 1*a* of the housing 1. A disc piston 3 is slidably disposed within the cylinder 2. The housing 1, the cylinder 2, and the piston 3 define a combustion chamber 22. A piston ring 21 composed of an elastic O-ring is retained by the piston 3. The O-ring 21 is seated between the cylinder 2 and the piston 3 to form an airtight interface between the cylinder 2 and the piston 3.

An approximately cylindrical guide 4 extends coaxially with the cylinder 2. An end of the guide 4 is connected to the end of the cylinder 2 remote from the housing 1. The guide 4 has an axial bore 4*a* extending therethrough and leading from the bore 2*a* of the cylinder 2. A fastener driver or fastener drive rod 6 fixed to the piston 3 slidably extends into the bore 4*a* of the guide 4. A fastener or nail 5 moved into the bore 4*a* of the guide 4 is driven by the rod 6. A magazine or feeder 7 attached to the guide 4 holds a row of fasteners or nails 5 and supplies them serially into the region of the guide bore 4*a* under the drive rod 6.

A fuel supply device 8 connected to the housing 1 serves to inject fuel into the housing 1. In general, the fuel consists of liquefied gas such as liquefied propane gas or liquefied butane gas. An air supply device 9 connected to the housing 1 serves to inject air into the housing 1. A valve unit 10 attached to the housing 1 selectively blocks and unblocks an exhaust passage connecting an interior of the housing 1 to atmosphere. A known synchronizing device ensures that blocking and unblocking of the exhaust passage by the valve unit 10 is synchronous with air injection by the air supply device 9. A high tension generator 11 using a piezoelectric element serves to generate a high voltage. The high tension generator 11 is supported on the housing 1. A spark plug 12 supported on the housing 1 is disposed within the housing 1. The spark plug 12 is electrically connected to the high tension generator 11 to receive a high voltage from the generator 11. When the spark plug 12 receives a high voltage, a spark is induced across the plug 12.

A partition wall 17 fixedly disposed within the housing 1 divides the interior of the housing 1 into an axially-extending circulation passage 18 and a cylindrical combustion chamber 22 coaxial with the bore 2*a* of the cylinder 2. A set of parallel gratings or grilles 14*a*, 14*b*, 14*c*, and 14*d* are disposed in the combustion chamber 22. The grilles 14*a*–14*d* extend perpendicular to the axis of the housing 1 and extend across the combustion chamber 22. The grilles 14*a*–14*d* are fixed to the housing 1 and the partition wall 17. The grilles 14*a*–14*d* are arranged in an axially spaced manner. The combustion chamber 22 is divided by the grilles 14*a*–14*d* into sub combustion chambers 22*a*, 22*b*, 22*c*, 22*d*, and 22*e*. The sub combustion chamber 22*e* nearest the piston 3 is defined by the grille 14*d* nearest the piston 3, the housing 1, the cylinder 2, and the piston 3. The grille 14*d* nearest the piston 3 prevents movement of the piston 3 from the cylinder 2 into the housing 1. The other sub combustion chambers 22*a*–22*d* are defined within the housing 1. Portions of the housing 1 and the partition wall 17 near the opening 1*a* define a passage 15 connecting the circulation passage 18 and the sub combustion chamber 22*d* next to the sub combustion chamber 22*e* nearest the piston 3. A mixing tube 20 fixedly disposed within a portion of the housing 1 near its closed end defines a passage 16 connecting the circulation passage 18 and the sub combustion chamber 22*a* farthest from the piston 3.

Figure 3:
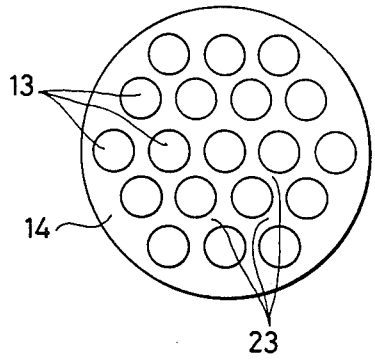
FIG. 3 is a plan view of the grating or grille of FIGS. 1 and 2.

The gratings or grilles 14*a*–14*d* have similar designs. FIG. 3 is a plan view of one of these gratings or grilles which is denoted by the reference numeral 14. As shown in FIGS. 1–3, each of the gratings or grilles 14*a*–14*d* is composed of a perforated disc having a plurality of circular apertures 13 which are uniformly distributed over the entire area of the disc. The walls 23 of the disc between the apertures 13 are thus arranged in the form of a 22*a*–22*e* communicate with each other via the apertures 13 of the gratings or grilles 14*a*–14*d*.

The fuel supply device 8 includes a fuel injection nozzle 19 extending coaxially into the mixing tube 20. The fuel injection nozzle 19 is axially spaced from the mixing tube 20. The fuel supply device 8 injects fuel into the mixing tube 20 via the nozzle 19. The spark plug 12 is disposed within the sub combustion chamber 22*a* nearest the housing closed end but farthest from the piston 3.

As best shown in FIG. 2, an end 24 of the cylinder bore 2*a* near the housing 1 has an increased diameter relative to a diameter of the remaining portion of the cylinder bore 2*a*. As the piston 3 moves toward the housing 1, the O-ring 21 finally enters the diameter-increased end 24 of the cylinder bore 2*a*. It is necessary to apply an external force stronger than a preset force to the O-ring 21 to move the O-ring 21 from the diameter-increased end 24 of the cylinder bore 2*a* to the remaining portion of the cylinder bore 2*a*, since the O-ring 21 is exposed to compressive deformation during this movement. Accordingly, once the O-ring 21 enters the diameter-increased end 24 of the cylinder bore 2*a*, the O-ring 21 remains in the diameter-increased end 24 until it receives an external force stronger than the preset force. Thus, once the O-ring 21 enters the diameter-increased end 24 of the cylinder bore 2*a*, the piston 3 remains in a corresponding position until the O-ring 21 receives an external force stronger than the preset force. This position of the piston 3 agrees with a rest or upper limit position of the piston 3 as viewed in FIGS. 1 and 2.

An elastic member 25 disposed within an end of the cylinder 2 near the guide 4 has a base bonded to the guide 4 and retained by the cylinder 2 and the guide 4. When the piston 3 moves toward the guide 4, the piston 3 finally encounters the elastic member 25. The piston 3 is stopped by the elastic member 25. The elastic member 25 determines a lower limit position of the piston 3 as viewed in FIGS. 1 and 2.

The cylinder 2 has radially-extending communication holes 26 connecting the cylinder bore 2*a* and atmosphere. Locations of the communication holes 26 are designed so that when the piston 3 moves into its lower limit position, the expanded combustion chamber 22 of the space defined by the housing 1, the cylinder 2, and the piston 3 is allowed to communicate with atmosphere via the communication holes 26. The cylinder 2 also has a radially-extending exhaust hole 27 connecting the cylinder bore 2*a* and atmosphere. The exhaust hole 27 extends between each communication hole 26 and the housing 1. Accordingly, a location of the exhaust hole 27 is higher than the location of the communication holes 26 as viewed in FIGS. 1 and 2.

Figure 4:
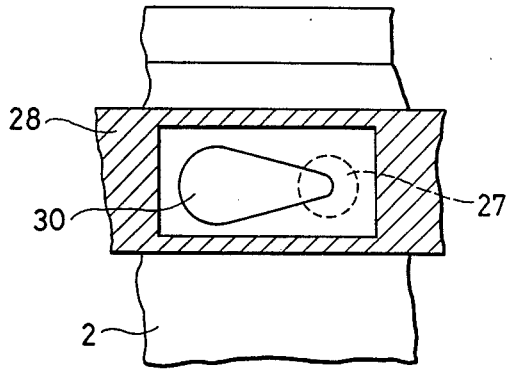
FIG. 4 is a sectional view of the drive power adjuster taken along the line IV—IV of FIG. 1.

A drive power adjuster 28 is slidably mounted on the outer surface of the cylinder 2 around the exhaust hole 27. FIG. 4 is a sectional view of the adjuster 28. As shown in FIGS. 1, 2, and 4, the adjuster 28 includes a body having an adjustment opening 30 which can communicate with the exhaust hole 27. The adjustment opening 30 is roughly triangular so that circumferential movement of the adjuster body relative to the cylinder 2 varies the area of the adjustment opening 30 directly opposing the exhaust hole 27. The adjuster body also has a valve opening 31 communicating with the adjustment opening 30. The valve opening 31 is selectively connected to and disconnected from atmosphere by a one-way valve 32 carried on the adjuster body. The one-way valve 32 allows gas flow from the interior of the cylinder 2 to atmosphere but inhibits air flow from atmosphere to the interior of the cylinder 2. In cases where the one-way valve 32 unblocks the valve opening 31, the effective cross-sectional area of a communication passage connecting the interior of the cylinder 2 to atmosphere depends on the position of the adjuster 28 relative to the cylinder 2 so that the rate of gas flow from the interior of the cylinder 2 to atmosphere varies as a function of the position of the adjuster 28 relative to the cylinder 2.

It should be noted that the adjuster 28 and the related exhaust hole 27 may be provided to the housing 1.

Operation of this fastener driving tool will follow. It is assumed that the piston 3 is in its rest or upper limit position where the O-ring 21 resides in the diameter-increased end 24 of the cylinder bore 2*a* as shown in FIG. 1. In this state, the air supply device 9 is activated and the valve unit 10 is controlled to unblock the related exhaust passage so that fresh air is injected into the combustion chamber 22 and used gas is moved from the combustion chamber 22 to atmosphere. When the fresh air replaces the used gas, the air supply device 9 is deactivated so that the injection of fresh air into the combustion chamber 22 is interrupted. At the same time, the valve unit 10 is controlled to block the related exhaust passage so that the fresh air is trapped in the combustion chamber 22.

Then, the fuel supply device 8 is activated so that fuel is injected via the nozzle 19 into the mixing tube 20. In general, the fuel supply device 8 feeds a metered quantity of fuel to the combustion chamber 22. The injected fuel flows from the passage 16 within the mixing tube 20 to the sub combustion chamber 22*a* from the piston 3. When the injected fuel is flowing in the passage 16, it mixes with air to form an air and fuel mixture. The mixture flows into the sub combustion chamber 22*a* farthest from the piston 3. This mixture flow causes air to move from the sub combustion chamber 22*d* to the sub chamber 22*a* via the passages 15, 16, and 18. When the air is moving in the passage 16 and the sub combustion chamber 22*a*, it axes with fuel to form an air and fuel mixture. At the same time, air moves from the sub combustion chambers 22*a*–22*c* to the sub combustion chamber 22*d* via the apertures 13 of the gratings or grilles 14*a*–14*c*. As a result, an air and fuel mixture fills the sub combustion chambers 22*a*–22*d*. In addition, the air and fuel mixture enters the sub combustion chamber 22*e* nearest the piston 3 through the apertures 13 of the grating or grille 14*d* nearest the piston 3.

When an air and fuel mixture fills the combustion chamber 22, the high tension generator 11 is activated so that a spark occurs across the spark plug 12 in the sub combustion chamber 22*a* remotest from the piston 3. This spark ignites the air and fuel mixture in the sub combustion chamber 22*a*. When the air and fuel mixture is ignited, it burns and thus a flame occurs. The resulting combustion gas in the sub combustion chamber 22*a* expands and thereby forces the unburned mixture toward the piston 3 via the apertures 13 of the gratings or grilles 14*a*–14*d*. When the unburned mixture passes through the apertures 13 of the gratings or grilles 14*a*–14*d*, the network walls 23 of the gratings or grilles 14*a*–14*d* form obstacles to flows of the unburned mixture. These obstacles cause turbulences of the unburned mixture in regions downstream thereof.

The flame travels from the sub combustion chamber 22*a* to the adjacent sub combustion chamber 22*b* via the apertures 13 of the grille 14*a* farthest from the piston 3. In the sub combustion chamber 22*b*, since turbulences of the unburned mixture are generated by the grille 14*a*, the flame advances at a higher speed. This higher flame speed increases the speed of expansion of the resulting combustion gas, thereby also increasing the speeds of unburned mixture flows from the sub combustion chamber 22*b* to the adjacent sub combustion chamber 22*c*. As a result, stronger turbulences of unburned mixture occur in the sub combustion chamber 22*c*. The flame travels from the sub combustion chamber 22*b* to the adjacent sub combustion chamber 22*c* via the apertures 13 of the grille 14*b*. In the sub combustion chamber 22*c*, the stronger turbulences of unburned mixture cause the flame to advance at a speed higher than the flame speed in the preceding sub combustion chamber 22*b*. The flame advances to the sub combustion chambers 22*d* and 22*e* via the apertures 13 of the grilles 14*c* and 14*d*. As is understood from the previous description, the flame speed increases each time it passes successively through one of the gratings or grilles 14*a*–14*d*. In this way, rapid combustion of an air and fuel mixture is ensured.

As the air and fuel mixture burns, the temperature and the pressure in the combustion chamber 22 rise so that the piston 3 is moved from its upper limit or rest position toward the guide 4 against the force of the O-ring 21. During this movement of the piston 3, the O-ring 21 is forced to move out of the diameter-increased end 24 of the cylinder bore 2*a* as shown in FIG. 2. The drive rod 6 moves together with the piston 3. As the drive rod 6 moves toward the guide 4, the drive rod 6 encounters a nail 5 and then drives the nail 5 into a workpiece 33 as shown in FIG. 2. In this way, the movement of the piston 3 from its rest position toward the guide 4 corresponds to a drive stroke of the piston 3.

As the piston 3 moves toward the guide 4, air escapes via the communication holes 26 into atmosphere from a compression chamber 34 (see FIG. 2) defined by the piston 3, the cylinder 2, the guide 4, and the elastic member 25. In addition, as the piston 3 moves toward the guide 4, the sub combustion chamber 22*e* nearest the piston 3 expands. During expansion of the sub combustion chamber 22*e*, the grille 14*d* nearest the piston 3 generates turbulences in the sub combustion chamber 22*e*. These turbulences increase the flame speed and thus cause a higher pressure so that a stronger drive force is applied to the nail 5 via the drive rod 6.

The drive force applied to the nail 5 is controlled via the adjuster 28. Specifically, the adjuster 28 controls the pressure in the combustion chamber 22. During a drive stroke of the piston 3, the piston 3 passes the exhaust hole 27 and thus the combustion chamber 22 expands to a range in which the combustion chamber 22 communicates with the exhaust hole 27. When the combustion chamber 22 communicates with the exhaust hole 27, the high pressure gas is allowed to open the one-way valve 32 and thereby to escape from the combustion chamber 22 into atmosphere via the exhaust hole 27, the adjustment opening 30, and the valve opening 31. The pressure in the combustion chamber 22 is adjusted with the rate of escape of the high pressure gas which depends on the area of the adjustment opening 30 directly opposing the exhaust hole 27. The position of the adjuster 28 relative to the cylinder 2 determines the area of the adjustment opening 30 directly opposing the exhaust hole 27. Accordingly, the pressure in the combustion chamber 22 is controlled via the adjuster 28 so that the drive power applied to the nail 5 is adjusted via the device 28. Specifically, the drive power rises as the adjuster 28 moves in the direction decreasing the area of the adjustment opening 30 directly opposing the exhaust hole 27. The drive power is maximized when the adjustment opening 30 is disconnected from the exhaust hole 27.

As the piston 3 moves toward the guide 4, the piston finally passes the communication holes 26 and encounters the elastic member 25. When the piston 3 passes the communication holes 26, the communication holes 26 are disconnected from the compression chamber 34 but are connected to the combustion chamber 22, so that air in the compression chamber 34 is compressed and the combustion gas escapes from the combustion chamber 22 into atmosphere via the communication holes 26. The escape of the combustion gas via the communication holes 26 abruptly drops the pressure and the temperature in the combustion chamber 22, thereby developing a vacuum in the combustion chamber 22. The vacuum in the combustion chamber 22, the resilience of the elastic member 25, and the compressed air in the compression chamber 34 cooperate to stop the piston 3 and then return the piston 3. In this way, the piston 3 is moved toward the housing 1.

During return of the piston 3, when the piston 3 passes the communication holes 26, the communication holes 26 are disconnected from the combustion chamber 22 but are connected to the compression chamber 34. The connection of the communication holes 26 to the compression chamber 34 allows atmosphere to enter the compression chamber 34 so that the compression chamber 34 is subjected to the atmospheric pressure. In this way, the side of the piston 3 opposing the compression chamber 34 is subjected to the atmosphere and the side of the piston 3 opposing the combustion chamber 22 is subjected to the vacuum. This pressure differential across the piston 3 facilitates the return of the piston 3.

The piston 3 continues to move toward the housing 1 until the piston 3 encounters the grille 14*d* nearest the piston 3. Immediately before the piston 3 contacts the grille 14*d*, the O-ring 21 moves into the diameter-increased end 24 of the cylinder bore 2*a*. When the piston 3 encounters the grille 14*d*, the piston 3 stops at its upper limit or rest position. The combination of the O-ring 21 and the diameter-increased end 24 of the cylinder bore 2*a* serves to hold the piston 3 in its rest position.

It should be noted that during return of the piston 3, the one-way valve 32 continues to block the valve opening 31, since a pressure higher than the atmospheric pressure does not occur within the cylinder 2.

Figure 5:
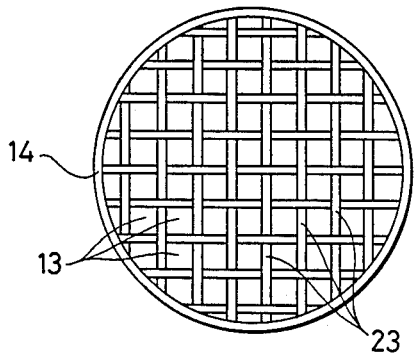
FIG. 5 is a plan view of a modified grating or grille.

It should be understood that the gratings or grilles 14*a*–14*d* may have other designs. FIG. 5 shows one example of a modified grating or grille 14. As shown in FIG. 5, the modified grating or grille 14 has an annular member defining a circular edge thereof. The modified grating or grille 14 has bars or strips 23 arranged in the form of a network or grid. An array of rectangular openings 13 are defined by the members 23. The bars or strips 23 extend across the annular edge member and are fixed to the annular edge member. The annular edge member is secured to the housing 1 and the partition wall 17 (see FIGS. 1 and 2).

Figure 6:
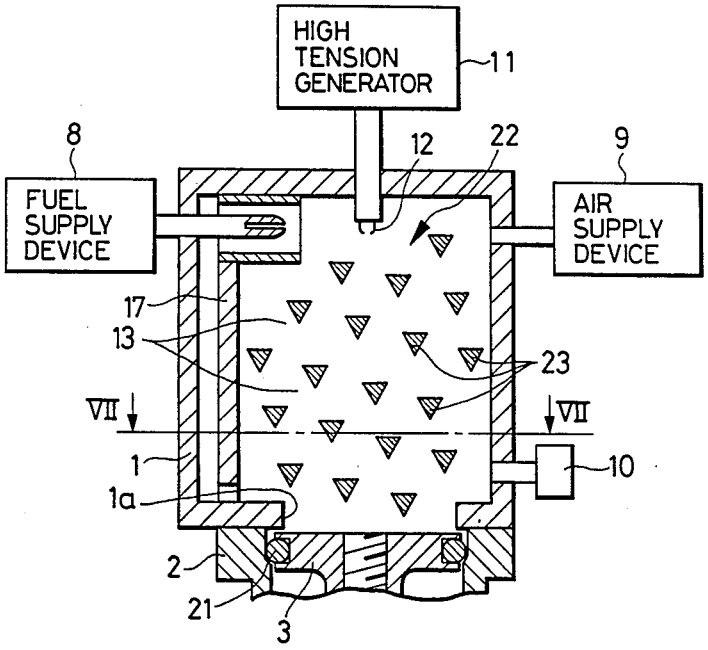
FIG. 6 is a sectional view of a combustion gas powered fastener driving tool according to a second embodiment of this invention.
Figure 7:
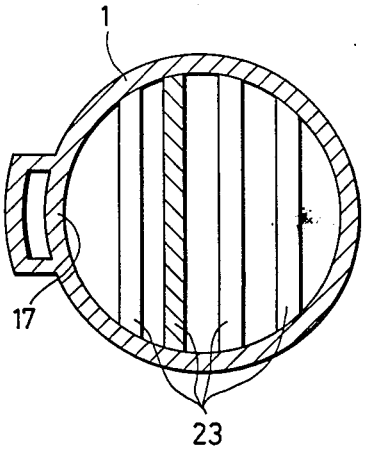
FIG. 7 is a sectional view taken along the line VII—VII of FIG. 6.

FIGS. 6 and 7 show a second embodiment of this invention, which is similar to the embodiment of FIGS. 1–5 except for the following design changes.

As shown in FIGS. 6 and 7, this embodiment includes bars 23 in place of the gratings or grilles 14*a*–14*d* (see FIGS. 1 and 2). The bars 23 extend across a combustion chamber 22 within the housing 1. Ends of the bars 23 are secured to the housing 1. The bars 23 preferably extend parallel to each other and extend perpendicular to the axis of the housing 1. The bars 23 are preferably distributed uniformly over a region of the combustion chamber 22 between the spark plug 12 and the housing end opening 1*a*. Interconnected apertures 13 are formed between the bars 23.

The bars 23 have a triangular cross-section. It should be noted that the bars 23 may have other cross-sections such as circular or rectangular cross-sections. The bars 23 are straight. It should be noted that the bars 23 may be curved.

When an air and fuel mixture is ignited by the spark plug 12, the mixture starts to burn. As the mixture starts to burn, the resulting combustion gas expands and forces unburned mixture toward the piston 3 so that mixture flows occur in the combustion chamber 22. The bars 23 serve to generate turbulences in the mixture flows. These turbulences increase the flame speed and thereby ensure rapid combustion of the mixture. As is understood from the previous description, the bars 23 constitute obstacle members for generating turbulences.

The diameter of the housing end opening 1*a* is smaller than the diameter of the piston 3 so that the walls of the housing 1 around the end opening 1*a* can stop the piston 3 and can prevent the piston 3 from moving into the housing 1.

Figure 8:
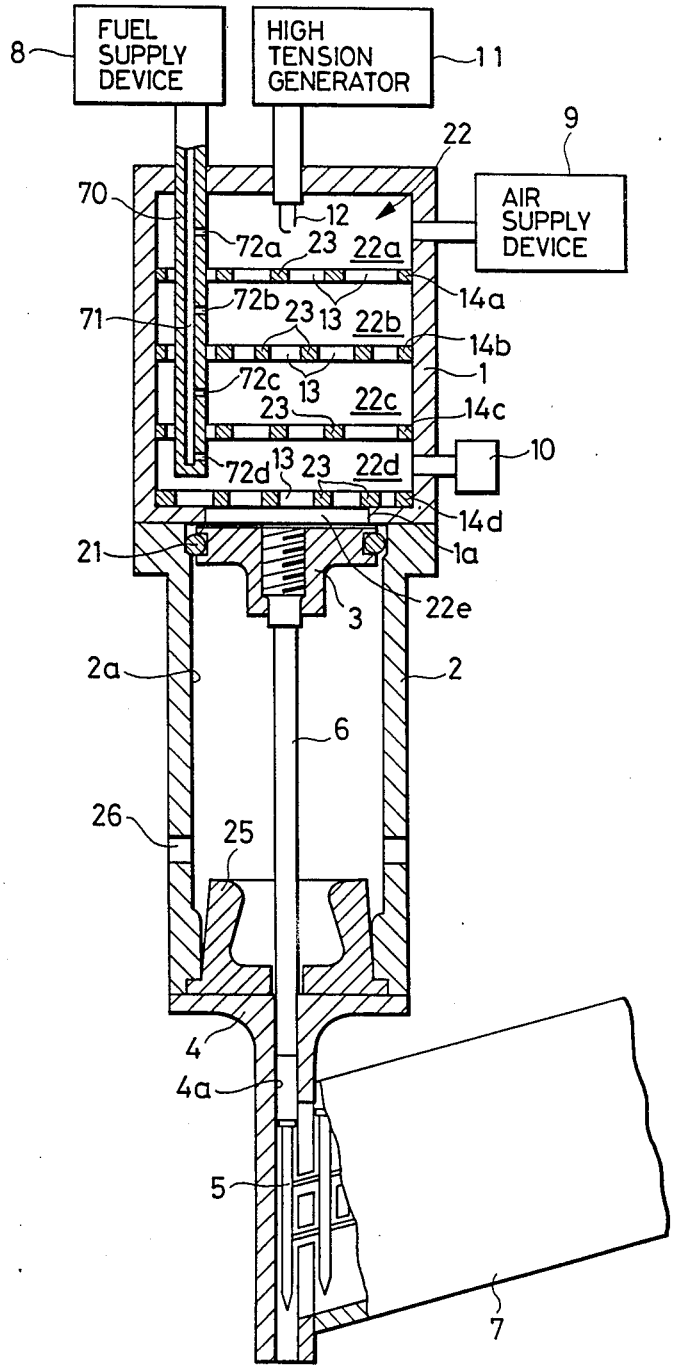
FIG. 8 is a sectional view of a combustion gas powered fastener driving tool according to a third embodiment of this invention.

FIG. 8 shows a third embodiment of this invention, which is similar to the embodiment of FIGS. 1–5 except for the following design changes.

As shown in FIG. 8, in this embodiment, the interior of the housing 1 is divided by the gratings or grilles 14*a*–14*d* into the sub combustion chambers 22*a*–22*e*. The partition wall 17, the passage 18, and the mixing tube 20 (see FIGS. 1 and 2) are omitted from this embodiment.

The fuel supply device 8 has a fuel feed tube 70 extending axially into the housing 1 through the end wall thereof. The fuel feed tube 70 extends through the grilles 14*a*–14*c* and terminates in the sub combustion chamber 22*d* between the grilles 14*c* and 14*d*. The fuel feed tube 70 defines a fuel passage 71. The fuel feed tube 70 has fuel injection holes or orifices 72*a*, 72*b*, 72*c*, and 72*d* leading from the fuel passage 71 and opening into the sub combustion chambers 22*a*, 22*b*, 22*c*, and 22*d* respectively.

Fuel driven from a main body of the fuel supply device 8 flows through the fuel passage 71 and then moves into the fuel injection holes 72*a*–72*d*. After the fuel flows through the fuel injection holes 72*a*–72*d*, the fuel discharges into the respective sub combustion chambers 22*a*–22*d*. In this way, fuel is injected via the holes 72*a*–72*d* into the respective sub combustion chambers 22*a*–22*d*. Accordingly, an approximately uniform air and fuel mixture is quickly produced in the entire combustion chamber 22. In other words, the entire combustion chamber 22 is quickly filled with an approximately uniform air and fuel.

The diameter of the housing end opening 1*a* is smaller than the diameter of the piston 3 so that the walls of the housing 1 around the end opening 1*a* can stop the piston 3 and can prevent the piston 3 from moving into the housing 1.

The adjuster 28 and the related exhaust passage 27 (see FIGS. 1 and 2) are omitted from this embodiment. It should be noted that the adjuster 28 and the related exhaust passage 27 may be provided in this embodiment.

Figure 9:
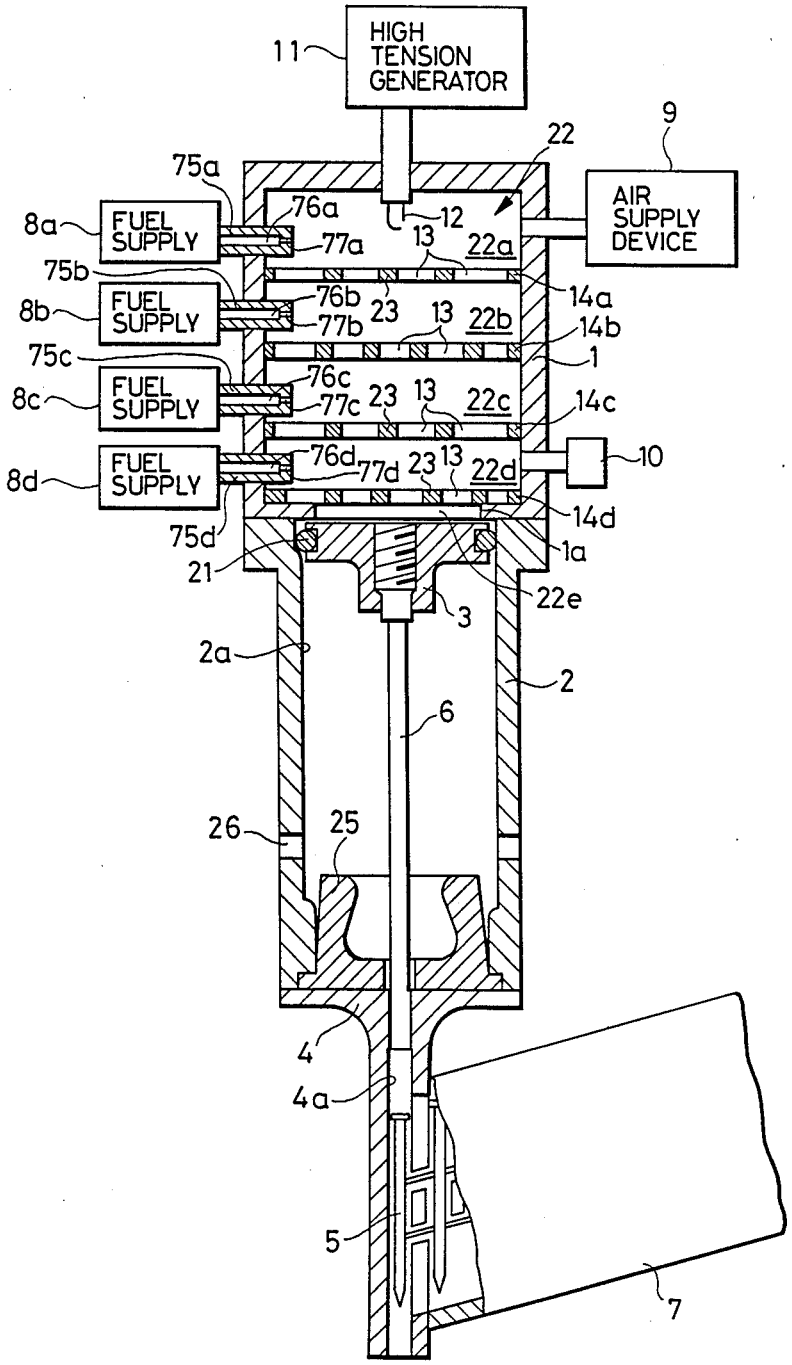
FIG. 9 is a sectional view of a combustion gas powered fastener driving tool according to a fourth embodiment of this invention.

FIG. 9 shows a fourth embodiment of this invention, which is similar to the embodiment of FIG. 8 except for the following design changes.

As shown in FIG. 9, this embodiment includes a plurality of similar fuel supply devices 8*a*, 8*b*, 8*c*, and 8*d* having fuel feed tubes 75*a*, 75*b*, 75*c*, and 75*d* respectively. The fuel feed tubes 75*a*, 75*b*, 75*c*, and 75*d* define fuel passages 76*a*, 76*b*, 76*c*, and 76*d* respectively. The fuel feed tubes 75*a*–75*d* extend into and terminate in the sub combustion chambers 22*a*–22*d* respectively. Ends of the fuel feed tubes 75*a*, 75*b*, 75*c*, and 75*d* are formed with fuel injection holes or orifices 77*a*, 77*b*, 77*c*, 77*d* leading from the fuel passages 76*a*, 76*b*, 76*c*, and 76*d* and opening into the sub combustion chambers 22*a*, 22*b*, 22*c*, and 22*d* respectively.

Fuels driven from main bodies of the fuel supply devices 8*a*–8*d* flow through the fuel feed passages 76*a*–76*d* and then discharge into the sub combustion chambers 22*a*–22*d* via the fuel injection openings 77*a*–77*d* respectively. In this way, fuels are injected via the holes 77*a*–77*d* into the respective sub combustion chambers 22*a*–22*d*.

The fuel supply devices 8*a*–8*d* are preferably connected via a synchronizing system so that fuel injections into the sub combustion chambers 22*a*–22*d* by the fuel supply devices 8*a*–8*d* can take place at essentially the same time.

What is claimed is:

1. A combustion gas powered tool comprising:

(a) a housing partially defining a combustion chamber;

(b) a movable piston partially defining the combustion chamber;

(c) means for generating an air and fuel mixture in the combustion chamber;

(d) means for igniting the air and fuel mixture in the combustion chamber; and (e) an obstacle member fixedly disposed in the combustion chamber for generating turbulence in an unburned portion of the air and fuel mixture after the air and fuel mixture is ignited;

wherein the obstacle member comprises spaced grilles extending across the combustion chamber and secured to the housing.

2. The tool of claim 1 further comprising means for adjusting pressure in the combustion chamber to control drive power applied to the piston.

3. The tool of claim 2 wherein the adjusting means comprises means for connecting the combustion chamber and atmosphere, and means for varying effective cross-sectional area of the connection between the combustion chamber and atmosphere.

4. A combustion gas powered tool comprising:

(a) a housing partially defining a combustion chamber;

(b) a movable piston partially defining the combustion chamber;

(c) means for generating an air and fuel mixture in the combustion chamber;

(d) means for igniting the air and fuel mixture in the combustion chamber; and (e) an obstacle member fixedly disposed in the combustion chamber for generating turbulence in an unburned portion of the air and fuel mixture after the air and fuel mixture is ignited;

wherein the housing has an opening and a closed portion opposing the opening, and further comprising means for defining a circulation passage which connects a portion of the combustion chamber near the opening of the housing to a portion of the combustion chamber near the closed portion of the housing, and a mixing tube defining an end of the circulation passage near the closed portion of the housing, the mixture generating means comprising a fuel injection nozzle disposed in the mixing tube and spaced from a wall of the mixing tube.

5. A combustion gas powered tool comprising:

(a) a housing partially defining a combustion chamber;

(b) a movable piston partially defining the combustion chamber;

(c) means for generating an air and fuel mixture in the combustion chamber;

(d) means for igniting the air and fuel mixture in the combustion chamber; and (e) an obstacle member fixedly disposed in the combustion chamber for generating turbulence in an unburned portion of the air and fuel mixture after the air and fuel mixture is ignited;

wherein the obstacle member comprises spaced bars extending across the combustion chamber and secured to the housing.

6. A combustion gas powered tool comprising:

(a) a housing partially defining a combustion chamber;

(b) a movable piston partially defining the combustion chamber;

(c) means for generating an air and fuel mixture in the combustion chamber;

(d) means for igniting the air and fuel mixture in the combustion chamber; and (e) an obstacle member fixedly disposed in the combustion chamber for generating turbulence in an unburned portion of the air and fuel mixture after the air and fuel mixture is ignited;

wherein the obstacle member comprises spaced grilles extending across the combustion chamber and secured to the housing, the grilles dividing the combustion chamber into sub combustion chambers which communicate with each other via openings in the grilles, the mixture generating means comprising means for injecting fuel directly into the respective sub combustion chambers.

* * * * *